United States Patent [19]

Abys et al.

[11] Patent Number: 5,024,733

[45] Date of Patent: Jun. 18, 1991

[54] PALLADIUM ALLOY ELECTROPLATING PROCESS

[75] Inventors: Joseph A. Abys, Warren; Heinrich K. Straschil, Summit, both of N.J.

[73] Assignee: AT&T Bell Laboratories, Murray Hill, N.J.

[21] Appl. No.: 523,290

[22] Filed: May 11, 1990

Related U.S. Application Data

[63] Continuation of Ser. No. 400,202, Aug. 29, 1989, abandoned.

[51] Int. Cl.[5] ..... C25D 3/56

[52] U.S. Cl. ..... 204/3; 204/44.6

[58] Field of Search ..... 204/44.6, 3

[56] References Cited

U.S. PATENT DOCUMENTS

| | | | |
|---|---|---|---|
| 3,475,292 | 10/1969 | Shoushanian | 204/44 |
| 3,776,821 | 12/1973 | Baker | 204/44.3 |
| 3,878,066 | 4/1975 | Dettke et al. | 204/44.3 |
| 3,897,246 | 7/1975 | Zimmerman et al. | 204/44.3 X |
| 3,933,602 | 1/1976 | Henzi et al. | 204/44 |
| 4,066,517 | 1/1978 | Stevens et al. | 204/44.6 |
| 4,098,656 | 7/1978 | Deuber | 204/47 |
| 4,468,296 | 8/1984 | Abys et al. | 204/47 |
| 4,486,274 | 12/1984 | Abys et al. | 204/44 |
| 4,487,665 | 12/1984 | Miscioscio et al. | 204/47 |
| 4,491,507 | 1/1985 | Herklotz et al. | 204/47 |
| 4,493,754 | 1/1985 | Abys et al. | 204/47 |
| 4,545,869 | 10/1985 | Goldman | 204/47 |
| 4,552,628 | 11/1985 | Wilcox et al. | 204/47 |
| 4,622,110 | 11/1986 | Martin et al. | 204/47 |
| 4,628,165 | 12/1986 | Noble et al. | 200/268 |

FOREIGN PATENT DOCUMENTS 50491 3/1988 Japan .

OTHER PUBLICATIONS

Frederick A. Lowenheim, "Electroforming", Chap. 20 in book Electroplating: Fundamentals of Surface Finishing, pp. 426–441 (1978).

*Primary Examiner*—John F. Niebling
*Assistant Examiner*—Isabelle R. McAndrews
*Attorney, Agent, or Firm*—W. G. Nilsen; O. E. Alber

[57] ABSTRACT

An electroplating process is described for electroplating alloys of palladium and arsenic. The resulting electrodeposits are bright, ductile and remain ductile and crack-free even when the electrodeposits are quite thick. The deposits are quite hard and suitable for contact surfaces particularly in situations where wear characteristics require thick deposits. The electroplating process is also useful for making articles such as bellows by electroform procedures particularly since the electroplated material has extraordinary physical properties (good resilience, low stress and ductility) as well as good corrosion resistance.

11 Claims, No Drawings

PALLADIUM ALLOY ELECTROPLATING PROCESS

This application is a continuation of application Ser. No. 07/400202, filed on Aug. 29, 1989.

TECHNICAL FIELD

The invention relates to a process for electroplating palladium-arsenic alloys.

BACKGROUND OF THE INVENTION

Electroplated palladium and palladium alloys are used in a variety of applications including deposition of protective coatings on decorative articles such as jewelry, watches, etc., in various containers and fixtures exposed to chemically corrosive liquids and gasses and in various electrical and electronic devices as a protective coating and electrical contact coating. Much of the motivation for use of palladium and palladium alloys in such applications is its lower cost compared to such traditionally-used metals as gold and platinum.

Early work on electroplating palladium and palladium alloys met with considerable difficulty. Often the electroplated palladium metal was not adherent, tended to be porous, often developed cracks and generally was quite brittle. Generally, such deposited palladium layers were not satisfactory either as electrical contact layers or as decorative coatings.

Investigation into the reason why electroplated palladium layers exhibit such poor quality soon revealed that this is due to the incorporation of hydrogen into the electroplated palladium layers. Hydrogen evolution often accompanies palladium electroplating because of the close proximity of the water electrolysis potential to the palladium electroplating potential. Incorporation of hydrogen into the electroplated palladium layers appeared to be responsible for the degraded properties of electroplated palladium. Indeed, many palladium electroplating processes appeared to work quite well under laboratory conditions where plating potential could be carefully controlled and the hydrogen evolution potential could be avoided and plating rates under these conditions are low. However, under commercial plating conditions, these processes proved unreliable either because the plating potential used was not precisely controlled or because higher plating rates required plating potentials that lead to the evolution of hydrogen during the electroplating process.

A major advance in palladium electroplating technology occurred with the discovery that certain palladium complex ions exhibited electroplating potentials far removed from the hydrogen evolution potential. The complexing agents involve certain aliphatic polyamines with best results obtained with 1,3 diamino propane. This work is described in U.S. Pat. No. 4,486,274 issued to J. A. Abys, et al on Dec. 4, 1984.

This discovery led to a major commercial effort in palladium electroplating. The process has been used extensively in the United States and throughout the world to electroplate palladium typically for electrical contact surfaces in various devices such as electrical connectors. It has generally been used in applications formerly requiring gold contact surfaces and has led to considerable cost savings because of the lower cost and lower density of palladium as compared to gold. Further development work has been done as described in such references as U.S. Pat. No. 4,468,296 issued to J. A. Abys et al on Aug. 28, 1984 (replenishment compound for a palladium electroplating process) and U.S. Pat. No. 4,493,754 issued to J. A. Abys et al on Jan. 15, 1985 (unique anode structure for use in palladium electroplating process). Often, the palladium layer of the contact surface is covered with a very thin layer of gold to improve wear and contact characteristics.

Because of the success of the palladium electroplating process involving aliphatic amines, further improvements both in the electroplating process and properties of the electroplated palladium have become desirable. In particular, cost reduction in the palladium electroplating process is desirable as is greater versatility in the choice of palladium electroplating species. Also, greater ductility and adhesion of the electroplated palladium is desirable particularly for relatively thick layers. Such thick layers of palladium metal and palladium alloys would be highly useful for devices where extended wear is required. Thickness of 25 μm or more are of interest for a variety of applications.

In addition, it is highly desirable to have an inert palladium alloy substance that is not affected by the evolution of hydrogen, electroplates easily even at high electroplating rates and produces electroplated layers of sufficient ductility and thickness so as to be useful for fabricating articles by electroform processes.

A variety of references have disclosed palladium electroplating processes including U.S. Pat. No. 4,487,665 issued to K. B. Miscioscio et al on Dec. 11, 1984; U.S. Pat. No. 4,491,507 issued to G. Herklotz et al on Jan. 1, 1985 and U.S. Pat. No. 4,545,869 issued to I. Goldman on Oct. 5, 1985. The palladium tetra-ammine complex is used as the source of palladium in a number of palladium electroplating processes including those described in U.S. Pat. No. 4,622,110 issued to J. L. Martin et al on Nov. 11, 1986; U.S. Pat. No. 4,552,628 issued to J. Wilcox on Nov. 12, 1985 and U.S. Pat. No. 4,628,165 issued to F. I. Nobel on Dec. 9, 1986.

SUMMARY OF THE INVENTION

The invention is a process for electroplating a palladium-arsenic alloy in which the electroplating bath comprises a source of palladium and a source of arsenic. A wide variety of palladium sources and arsenic sources may be used in the practice of the invention. Two convenient sources of palladium are palladium complexed with 1,3 diaminopropane and ammonia. Convenient sources of arsenic are $As_2O_3$ and $As_2O_5$. Concentrations of the source of palladium and source of arsenic may vary over wide limits from about 0.00001 molar to saturation for both sources. Optionally, other ingredients may be contained in the electroplating bath including various additives such as surfactants and brighteners and buffers to maintain the pH of the solution. The procedure yields excellent electroplated layers which are adherent, crack free and ductile even when the layers are quite thick. The procedure also yields excellent results in making free standing articles (such as bellows) by electroforming procedures.

DETAILED DESCRIPTION

The invention is based on the discovery that electroplating a metallic substance from an aqueous bath containing a source of palladium and a source of arsenic yields a metallic film comprising palladium and arsenic which is ductile, crack-free, extremely adherent and which retains these properties even when electroplated to considerable thickness (e.g. 10 μm or even more). In addition, the electroplated metallic substance is quite hard with Knoop Hardness (KHN) over 400. The metallic film appears to be an alloy of palladium and arsenic and exhibits sufficient ductility and strength so as to be useful for making free standing articles such as bellows by electroforming procedures. Plating rates can be quite high (e.g. 300, 500 or even 1000 ASF at the cathode) without deleterious effects on the properties of the electroplated metallic film. Although the reason for the extraordinary good properties of electroplated palladium-arsenic alloy is not completely understood, it appears possible that part of the reason is that hydrogen does not have a deleterious effect on the properties of this electroplated material.

A wide variety of palladium compounds may be used as a source of palladium in the electroplating process provided the palladium compound is compatible with the plating process. Particularly useful are palladium complex ion compounds with ammonia as the complexing agent such as $Pd(NH_3)_2Cl_2$ and the corresponding bromide and iodide. Also useful are palladium tetraammine salts such as $Pd(NH_3)_4Cl_2$ and the corresponding bromide and iodide. Other stable anions may be used such as sulfates, etc. Also useful are palladium complexes in which the complexing agent is an organic compound such as an amine (see for example U.S. Pat. No. 4,486,274 which is incorporated by reference). Excellent results are obtained with 1,3 diaminopropane. Also useful as a source of palladium are palladium complex hydroxides such as palladium hydroxide complexed with various organic compounds such as organic amines and polyamines and complexed with ammonia (e.g. di-$\mu$-hydroxo-bis-[cis-diamminepalladium(II)] dihydroxide. Various simple palladium compounds may also be used such as $PdCl_2$ and the corresponding bromide and iodide, $PdSO_4$,$Pd(NO_3)_2$, etc.

A wide range of concentrations of the source of palladium and source of arsenic may be used with excellent results. For convenience, some reasonable bath conductivity should be used, generally a conductivity greater than 0.001 mho-cm. The concentration of the source of palladium may vary from 0.00005M to saturation. Excellent results are obtained in the concentration range from 0.005 to 1.0M with 0.05 to 0.3 most preferred. Too low a concentration requires frequent replenishments; too high a concentration increases palladium loss due to drag out. Where the source of palladium is a complex palladium ion, excess complexing agent is often used. The concentration of excess complexing agent typically ranges from about 0.5 to 30 times the molar concentration of palladium. With palladium complexed with 1,3 diaminopropane, excellent results are obtained with 0.08M palladium complex and 0.7M excess complexing agent.

Any source of arsenic may be used provided it is compatible with the electroplating process and has reasonable solubility in the bath. Typical sources of arsenic are $As_2O_3$,$As_2O_5$, $KH_2AsO_4$,$K_2HAsO_4$, $K_3AsO_4$, $NaH_2AsO_4$, $Na_2HAsO_4$,$Na_3AsO_3K_3AsO_3$, $KAsO_2$,-$Na_3AsO_3$, $NaAsO_2$ and $Na_4As_2O_7$. Other arsenic compounds may also be useful. For convenience, $As_2O_3$ and $As_2O_5$ are preferred. A convenient procedure for incorporating the arsenic in the bath is to make an alkali-metal salt of arsenous acid by dissolving $As_2O_3$ in concentrated potassium or sodium hydroxide solution and adding this solution to the electroplating bath.

The concentration of arsenic in the bath may vary over large limits, typically from 0.00005M to saturation. Excellent results are obtained in the concentration range from 0.0005 to 0.5 with best results in the concentration range from 0.01 to 0.1M. Often, it is extremely convenient to maintain the molar ratio of palladium to arsenic approximately equal to that of the material being plated out of the solution. Under these conditions, the molar ratio of palladium to arsenic in the electroplating bath remains constant throughout the electroplating process. For example, where the material being plated out has a molar composition of 20 percent arsenic and 80 percent palladium, it is convenient to have the mole ratio of palladium to arsenic in the bath between 2 and 6, preferably 4. The alloy appears quite hard, with Knoop Hardness (KHN) over 400.

For solubility reasons, it is preferable to have the pH above 7; typically between 8 and 13.5 or even between 10 and 12.5. The pH is conveniently adjusted by the addition of alkali-metal hydroxide such as potassium hydroxide and sodium hydroxide.

Optionally, additional substances may be added to the electroplating bath to improve the quality of the electroplated material, control pH, increase conductivity of the bath, etc. For example, both a surfactant and a brightener may be added to the electroplating bath. Typical surfactants that are useful are aliphatic quaternary ammonium salts with from 4–35 carbon atoms. Preferred are aliphatic straight-chain trimethylammonium chlorides with chain lengths between 8 and 18 carbon atoms. More preferred are the quaternary salts with chain lengths between 11 and 13 carbon atoms (e.g. undecyltrimethyammonium chloride, dodecyltrimethylammonium chloride and tridecyltrimethylammonium chloride) with dodecyltrimethylammonium chloride most preferred. The concentration of the surfactant may vary over large limits. Typical concentration ranges are from 0.0002 to 0.4 molar with the range from 0.004 to 0.02 molar preferred. Too low a concentration limits the desired effect (as a wetting agent to remove bubbles from the cathode, make the plating more uniform and disburse the brightener); too high a concentration sometimes causes foaming of the bath, phase separation of the surfactant or decreased effectiveness of the brightener.

Various brighteners may also be used in the practice of the invention. Typical brighteners useful in the practice of the invention are often sulfur-containing organic acids and their salts. Typical examples are o-benzaldehydesulfonic acid, 1-naphthalenesulfonic acid, 2-naphthalenesulfonic acid, benzenesulfinic acid, oxy 4,4 bis(-benzene)sulfinic acid, p-toluenesulfinic acid, and 3-trifluoromethylbenzene sulfinic acid. Additional brightening agents useful in the practice of the invention are ally phenyl sulfone, o-benzoic sulfamide, benzyl sulfonyl propionamide, phenylsulfonylacetamide, 3 (phenylsulfonyl) propionamide, benzenesulfonamide, bis(phenylsulfonyl)methane, guanidine carbonate, sulfaguanidine and nicotinic acid. Preferred are the following brightening agents: benzenesulfonic acid, 3-trifluoromethylbenzenesulfinic acid and ally phenyl sulfone with allyl phenyl sulfone most preferred. Too low a concentration sometimes limits the brightness of the deposits; too high a concentration occasionally causes streaking of the deposits. Concentration of the brightener may vary over large limits; for example from 0.00005 molar to saturation with 0.005 to 0.2 molar preferred and 0.01 to 0.05 most preferred.

Most preferred is the combination of dodecyltrimethylammonium chloride and allyl phenyl sulfone as surfactant and brightener respectfully with a concentration of 0.01 molar for the surfactant and 0.03 molar for brightener.

A buffer may also be used to control the pH of the bath and incidentally to increase the conductivity of the bath. Any buffer consistent with the desired pH and the electroplating process may be used. A typical buffer for the pH values of interest here is the phosphate system (e.g. $HPO_4^=$ ions). Typical concentrations are 0.01 to 2.0 molar with 0.5±0.2 preferred. The pH is usually adjusted by the addition of acid (e.g. hydrochloric acid or phosphoric acid) or base (e.g. aqueous ammonia or potassium hydroxide). Conducting salts may also be added (e.g. ammonium chloride) to increase the conductivity of the electroplating bath.

The temperature at which the electroplating process is carried out may vary over large limits, say from the freezing point of the electroplating bath to the boiling point of the bath. In some situations, temperatures close to room temperature are used for convenience but usually some elevated temperature (e.g. 35–60 deg. C.) is used to increase solubility of the bath ingredients and permit higher plating rates and more uniform platings. Preferred is an electroplating temperature of about 55 degrees C.

The invention is conveniently illustrated by a description of several examples of the inventive process.

EXAMPLE 1

An aqueous electroplating bath is made up using 0.08 molar $Pd(NH_3)_4Cl_2$, 0.05 molar $As_2O_3$ and 0.01 molar $K_2HPO_4$. Included in the solution are a surfactant (dodecyltrimethylammonium chloride) and a brightener (allyl phenyl sulfone) in concentrations of 0.01 molar and 0.03 molar respectively. The bath has a conductivity greater than $10^{-3}$ mho-cm. Excellent results are obtained on electroplating on a conductive surface (e.g. metallic surfaces such as copper, nickel, palladium, etc.).

EXAMPLE 2

Excellent results are obtained with the same bath as Example 1 but the following sources of palladium substituted for $Pd(NH_3)_4Cl_2$:$Pd(NH_3)_4Br_2$, $Pd(NH_3)_4I_2$, $Pd(NH_3)_4SO_4$, $Pd(NH_3)_4(NO_3)_2$, $Pd(NH_3)_2Cl_2$ and corresponding bromides, iodides, sulfates and nitrates, palladium complexed with organic amines such as 1,3-diamino propane, 1,2-diaminopropane, diethylenetriamine, 1,4-diaminobutane, 1,6-diaminohexane, N,N'dimethyl-1,3 propanediamine, N,N,N',N'-tetramethyl-ethylenediamine and ethylenediamine.

EXAMPLE 3

Same as Example 1 except the concentration of the source of palladium is 0.00005M, 0.005M, 0.05M, 0.3M, 1.0M and saturation.

EXAMPLE 4

Excellent results are obtained where the bath is as in Example 1 but the source of arsenic is $As_2O_5$,$KH_2AsO_4$, $K_2HAsO_4$, $K_3AsO_4$,$NaH_2AsO_4$, $Na_2HAsO_4$,-$Na_3AsO_3K_3AsO_3$, $KAsO_2$,$Na_3AsO_4$, $K_3AsO_2$, and $Na_4As_2O_7$.

EXAMPLE 5

Same as Example 1 except the concentration of the source of arsenic is 0.00005M, 0.0005M, 0.01M, 0.1M, 0.5M and saturation.

EXAMPLE 6

Excellent results are obtained with surfactants selected from aliphatic, straight-chain trimethylammonium chlorides with chain lengths from 8 to 18 carbon atoms.

EXAMPLE 7

Excellent results are obtained where the surfactant concentration is 0.0002M, 0.004M, 0.01M, 0.02M, 0.4M and saturation.

EXAMPLE 8

Excellent results are obtained with a variety of brightener compounds including o-benzaldehydesulfonic acid, 1-naphthalenesulfonic acid, 2-naphthalene sulfonic acid, benzenesulfinic acid, oxy 4,4 bis(benzene)-sulfinic acid, p-toluenesulfinic acid, 3-trifluoromethylbenzenesulfinic acid, allyl phenyl sulfone, o-benzoic sulfamide, benzylsulfonylpropionamide, phenylsulfonylacetamide, 3 (phenyl sulfonyl)propionamide, benzenesulfonamide, bis(phenylsulfonyl)methane, guanidine carbonate, sulfaguanidine and nicotinic acid.

EXAMPLE 9

Excellent results are obtained with brightener concentrations of 0.00005M, 0.005M, 0.01M, 0.03M, 0.05M, 0.2M and saturation.

EXAMPLE 10

As in Example 1 except the pH is adjusted to 6.0, 7.0, 7.5, 8.0, 8.5, 9.0, 10.0, 11.0, 11.5, 12.0, 13.0 and 13.5.

Edge card connectors are particularly well made in accordance with the inventive electroplating process. Bright, crack-free, ductile and adherent electrodepositions are obtained even with thicknesses of 2.5 to 5.0 μm and thicker. Other electrical contact surfaces are advantageously made in accordance with the invention particularly where relatively thick plating deposits are required (relay contacts, electrical plugs, etc.). Often, a thin gold layer is put on top of the palladium-arsenic layer to improve wear characteristics and improve electrical performance.

The electroplating process is also advantageously used in various electroforming processes because the electrodeposits can be made thick and the electrodeposits have advantageous physical and chemical properties. In electroforming, the palladium-arsenic alloy is deposited on a mold or mandrel and the alloy subsequently separated from the mold and mandrel. A number of references describe the electroforming process including the chapter entitled "Electroforming" in "Electroplating" by F. A. Lowenheim, McGraw-Hill, 1978, Cha. 20.

Various articles are advantageously made by the electroform process including phonograph record masters, stampers, embossing plates, thin-wall articles such as foils, sheets, fine-mesh screen, seamless tubing, bellows for hydrophone devices, molds and dies for rubber and plastics, etc. Particularly advantageous is the combination of extreme chemical stability and resistance to chemical attack together with good metallurgical properties such as hardness, ductility, flexibility, etc.

We claim:

1. A process of electroplating a metallic substance onto a surface, said metallic substance comprising palladium and arsenic, said process comprising the step of passing current through a cathode, an electroplating bath and an anode, said electroplating bath comprising a source of palladium and a source of arsenic and having an electrical conductivity greater than $10^{-3}$ mho-cm and pH greater than 7, said source of palladium comprises a palladium complex ion with a complexing agent selected from the group consisting of ammonia, diaminopropane, 1,4-diamino butane, 1,6-diaminohexane, and 2-hydroxyl-1,3-diaminopropane, said source of arsenic is selected from the group consisting of $As_2O_3$, $As_2O_5$, $KH_2AsO_4$, $K_2HAsO_4$, $K_3AsO_4$, $NaH_2AsO_4$, $Na_2HAsO_4$, $Na_3AsO_4$, $K_3AsO_3$, $KAsO_2$, $Na_3AsO_3$, $NaAsO_2$ and $Na_4As_2O_7$, said electroplating bath having a palladium concentration of from 0.005 to 1.0 molar, and an arsenic concentration of from 0.01 molar to 0.1 molar.

2. The process of claim 1 in which said diaminopropane is 1,3-diaminopropane.

3. The process of claim 1 in which the source of arsenic is selected from the group consisting of $As_2O_3$ and $As_2O_5$.

4. The process of claim 1 in which the electroplating bath further comprises a surfactant and a brightener.

5. The process of claim 1 in which the electroplating bath further comprises a phosphate buffer.

6. The process of claim 5 in which the buffer comprises phosphate.

7. The process of claim 1, in which the concentration of palladium in the electroplating bath ranges from 0.05 to 0.3 molar.

8. A process of electroplating a metallic substance on a surface, said metallic substance comprising palladium and arsenic, said process comprising the step of passing current through a cathode, an electroplating bath and an anode with cathode potential great enough to electroplate the metallic substance, said electroplating bath comprising a source of palladium and a source of arsenic and having an electrical conductivity greater than $10^{-3}$ mho-cm and pH greater than 7, said source of palladium comprises a palladium complex ion with complexing agent selected from the group consisting of ammonia and 1,3-diaminopropane, said source of arsenic is selected from the group consisting of $As_2O_3$ and $As_2O_5$, said electroplating bath having a palladium concentration of from 0.005 to 1.0 molar and an arsenic concentration of from 0.01 molar to 0.1 molar.

9. The process of claim 1, in which the concentration of palladium in the electroplating bath ranges from 0.05 to 0.3 molar.

10. The process of claim 1 in which the electroplating bath further comprises a surfactant and a brightener.

11. The process of claim 1 in which the electroplating bath further comprises a phosphate buffer.

* * * * *